US005390815A

United States Patent [19]

Spiegel

[11] Patent Number: 5,390,815

[45] Date of Patent: Feb. 21, 1995

[54] CONTAINER WITH ADJUSTABLE COMPARTMENTS

[75] Inventor: Mark B. Spiegel, 75 West Hartsdale Ave. #10, Hartsdale, N.Y. 10530

[73] Assignee: Mark Bernard Spiegel, Hartsdale, N.Y.

[21] Appl. No.: 224,250

[22] Filed: Apr. 7, 1994

Related U.S. Application Data

[63] Continuation-in-part of Ser. No. 110,351, Aug. 23, 1993, abandoned.

[51] Int. Cl.[6] ..... B60R 5/00

[52] U.S. Cl. ..... 220/529; 220/530; 220/552; 206/583

[58] Field of Search ..... 220/529, 530, 544, 552; 206/583, 591, 593

[56] References Cited

U.S. PATENT DOCUMENTS

| | | | |
|---|---|---|---|
| 1,178,485 | 4/1916 | Astley | 217/23 |
| 1,940,048 | 12/1933 | Cutler | 312/301 |
| 2,884,154 | 4/1959 | Hobson | 220/552 |
| 2,977,043 | 3/1961 | Scheldorf | 206/583 X |
| 4,258,856 | 3/1981 | Marling | 220/552 |
| 4,735,320 | 4/1988 | Hoss | 206/583 |
| 5,052,580 | 10/1991 | Khoury | 220/552 X |
| 5,133,489 | 7/1992 | Loew et al. | 220/529 X |
| 5,265,993 | 11/1993 | Wayne | 220/552 X |

*Primary Examiner*—Steven M. Pollard
*Attorney, Agent, or Firm*—Felfe & Lynch

[57] ABSTRACT

A rectangular box is provided with parallel slots in the sidewalls and parallel slots in the endwalls. Elongate pieces of elastomeric material extend across the interior of the box and through the slots. The pieces can be positioned in a plurality of positions by holes in the pieces which fit on projections in the slots.

7 Claims, 2 Drawing Sheets

CONTAINER WITH ADJUSTABLE COMPARTMENTS

This application is a continuation-in-part of U.S. application Ser. No. 08/110,351, filed Aug. 23, 1993, now abandoned.

BACKGROUND OF THE INVENTION

The invention relates to a container having compartments of adjustable size.

In the interest of neatness, and to prevent spillage and breakage, it is well known to put containers of liquid and the like in a box; boxes having fixed compartments such as soda cases are well known for this purpose. However, boxes having compartments for different sized containers are not readily available. Thus, if it is desired to store different sized containers snugly in a box, a box of a certain size must be chosen. Otherwise the containers may roll around loosely and be subject to breakage and/or spillage.

The above described problem is often associated with liquids such as antifreeze, windshield fluid, oil and the like being carried in the trunk of an automobile. It is especially desired to fix such containers in a box regardless of the number of containers in the box.

SUMMARY OF THE INVENTION

A rectangular box is provided with at least one slot in each sidewall and at least one slot in each endwall. Elongate pieces of elastic material are stretched between sidewalls and between endwalls and passed through the slots. Pins fixed to the ends of the elastic pieces to form a tee at each end are drawn against the outside surface, where they are held in place by grooves formed in the plastic. In an alternative embodiment the slots are formed with upstanding projections and the elastic pieces are each formed with a row of holes extending lengthwise and engageable on the projections.

The box is preferably a molded plastic box with a slot in each wall, however each slot may be broken into several serially extending slots in order to provide greater structural strength. It is envisioned to sell the box and the elastic pieces in a kit for assembly by the user.

DETAILED DESCRIPTION OF THE PREFERRED EMBODIMENTS

Figure 1:
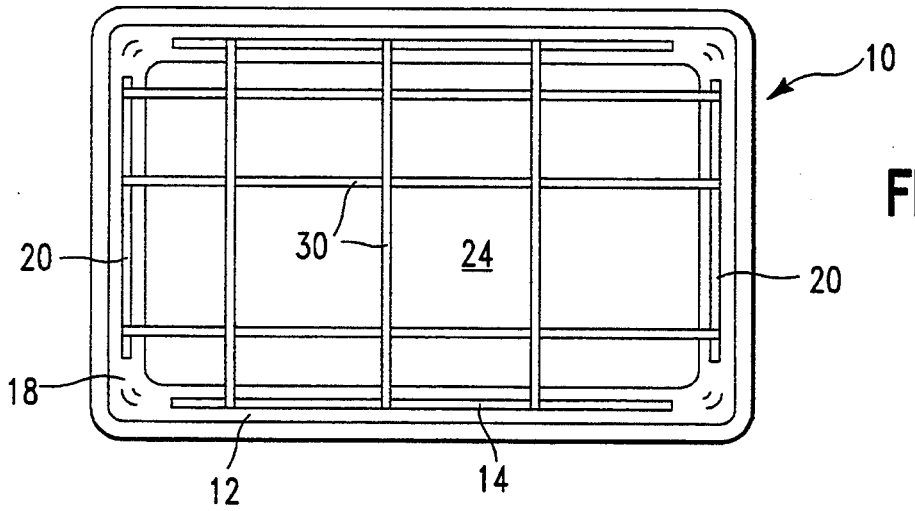
FIG. 1 is a plan view of the container with elastic pieces installed.

Referring to FIG. 1, a molded plastic box 10 has a pair of opposed sidewalls 12, a pair of opposed endwalls 18, and a floor 24 defining an interior space crossed by elongate pieces 30 of elastic material. Each sidewall 12 has a horizontal slot 14, three pieces 30 extending between sidewalls and through respective slots 14. Each endwall 18 has a horizontal slot 20, three pieces 30 extending between sidewalls and through respective slots 20.

Figure 2:
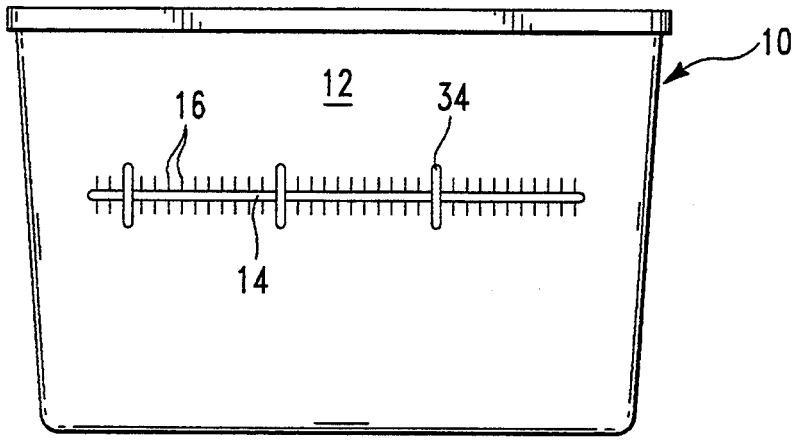
FIG. 2 is a side elevation.
Figure 3:
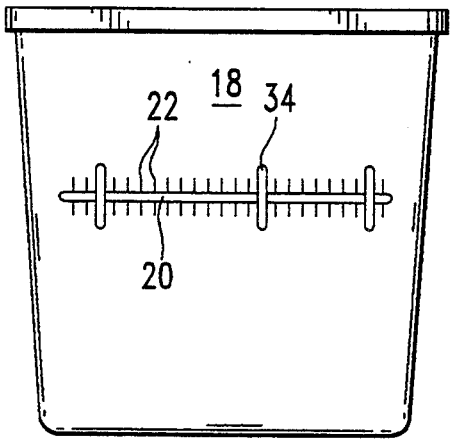
FIG. 3 is an end elevation.

FIG. 2 shows the outside surface of a sidewall 12. Vertical grooves 16 are formed in the exterior surface perpendicularly to slot 14 and serve to seat pins 34 fixed to the elastic pieces 30. FIG. 3 shows the outside surface of an endwall 18. Vertical grooves 22 are formed in the exterior surface perpendicularly to slot 20 and likewise serve to seat pins 34.

Figure 4:
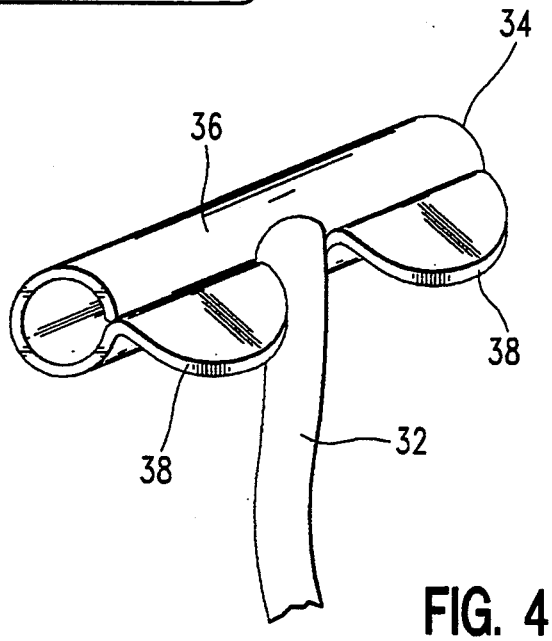
FIG. 4 is a detailed perspective of the end of an elastic piece.

FIG. 4 is a detailed perspective of the pin 34 fixed to elastic material 32, here a cord of butyl rubber or the like. The pin 34 is a piece of stamped metal formed with a barrel 36 which is crimped to the cord 32. The pin 34 is formed with tabs 38 extending outwardly from the barrel on either side of the midpoint where the cord is received in the barrel.

Figure 5:
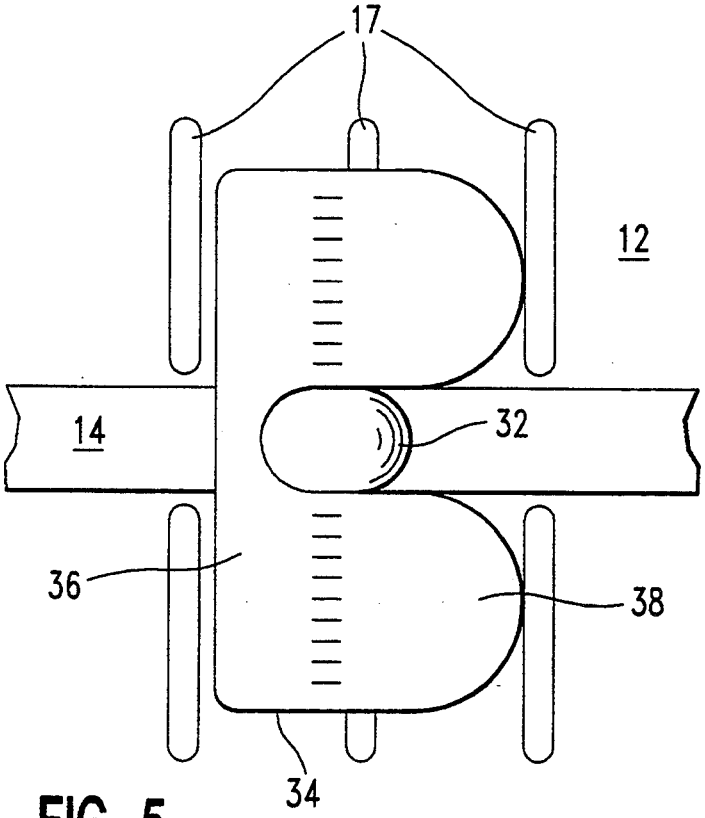
FIG. 5 is an elevation of a retaining pin drawn against the outside surface of the box.

FIG. 5 is a detail of a retaining pin 34 drawn against the outside surface of a sidewall 12. Here the crimp barrel 36 is seated between ridges 17 which form grooves therebetween. Tabs 38 are substantially flush with the surface due to torsional forces on barrel 36 by elastic piece 32. Ridges 17 may facilitate grasping the tabs away when it is desired to rearrange the compartments in the box.

While the seating pin 34 as shown is stamped and formed from metal, constructions using molded plastic are also envisioned.

Figure 8:
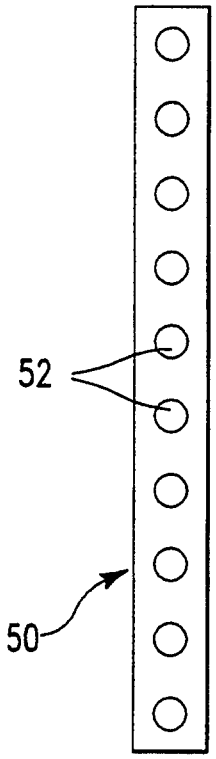
FIG. 8 is a plan view of the elastic piece used in the alternative box.
Figure 7:
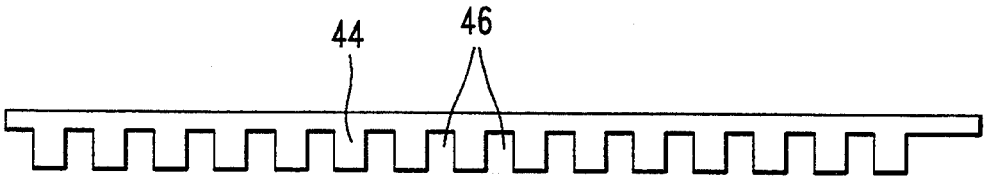
FIG. 7 is an elevation of a sidewall slot in the box of FIG. 6.
Figure 6:
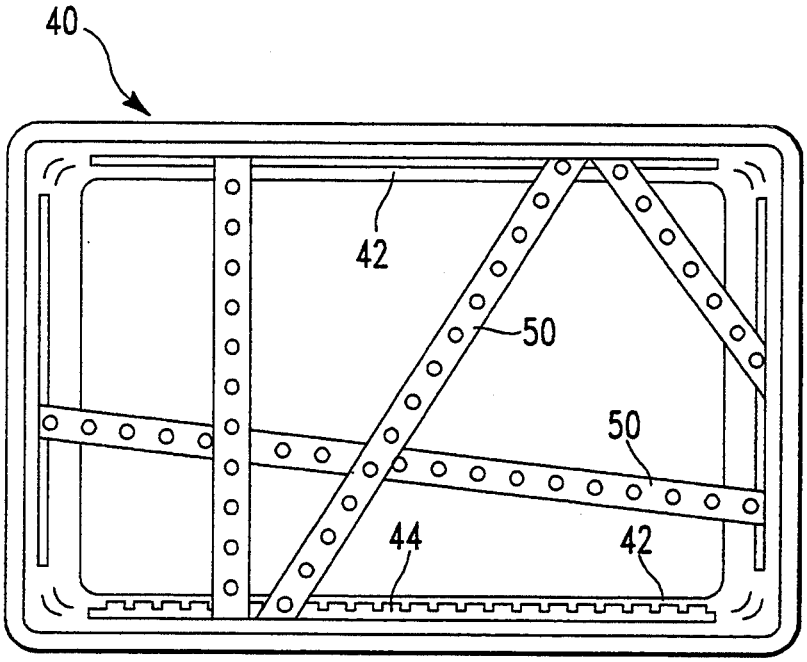
FIG. 6 is a plan view of an alternative box.

Referring to FIGS. 6–8, the box 40 and elongate pieces 50 in the form of elastomeric ribbons represent an alternative embodiment. Sidewalls 42 have respective slots 44 with upstanding projections 46 which serve as hooks for holes 52 in elastic strip 50. The endwalls are configured with like slots. The elastic strips may thus be stretched to any desired tension to form any desired array of compartments, individual strips extending not only sidewall to sidewall and endwall to endwall, but sidewall to endwall as shown.

The foregoing is exemplary and not intended to limit the scope of the claims which follow.

I claim:

1. A container having adjustable compartments, said container comprising a box having an exterior surface and an interior defined by at least one sidewall, said sidewall having slot means therein, said slot means having a plurality of upstanding projections therein, and at least one elongate piece of elastomeric material having a pair of opposed ends and extending across said interior and through said slot means of said at least one sidewall, each said elongate piece of elastomeric material having a plurality of holes positioned lengthwise along said piece, each said hole being profiled to fit on a respective said projection, whereby said elongate piece may be positioned in any of a plurality of positions with respect to said slot means through which said piece extends.

2. A container as in claim 1 wherein said box is substantially rectangular, said interior being defined by a pair of sidewalls, a pair of endwalls connecting said sidewalls, and a bottom.

3. A container as in claim 2 further comprising slot means in each of said endwalls.

4. A container as in claim 3 further comprising at least one elongate piece of elastomeric material extending across said interior and through said slot means of at least one endwall.

5. A container having adjustable compartments, said container comprising a substantially rectangular box having an exterior surface and an interior defined by a pair of sidewalls, a pair of endwalls connecting said sidewalls, and a bottom, said sidewalls having slot means therein, said exterior surface being provided with a plurality of groove means extending transversely of each slot means, at least one elongate piece of elastomeric material having a pair of opposed ends and extending across said interior and through said slot means of said sidewalls, and a pair of retaining pins having respective mid points fixed to respective ends of each said elongate piece of elastic material, said pins being positioned in respective grooves and drawn against said exterior surface by said elastomeric material.

6. A container as in claim 5 wherein said each pin is provided with a pull tab on at least one side of said midpoint.

7. A container as in claim 6 wherein said pin is stamped and formed from metal with integral tab means, said pin being crimped onto the end of said elastomeric piece.

* * * * *